US011077459B2

(12) United States Patent
McFadden et al.

(10) Patent No.: US 11,077,459 B2
(45) Date of Patent: Aug. 3, 2021

(54) DIRECTIONAL AIR APPARATUSES, SYSTEM, AND METHODS OF USING THE SAME

(71) Applicant: Global Finishing Solutions LLC, Osseo, WI (US)

(72) Inventors: William McFadden, Barrie (CA); Brandon Lowder, Eau Claire, WI (US)

(73) Assignee: Global Finishing Solutions LLC, Osseo, WI (US)

( * ) Notice: Subject to any disclaimer, the term of this patent is extended or adjusted under 35 U.S.C. 154(b) by 0 days.

(21) Appl. No.: 14/725,747

(22) Filed: May 29, 2015

(65) Prior Publication Data

US 2015/0343476 A1 Dec. 3, 2015

Related U.S. Application Data

(60) Provisional application No. 62/004,505, filed on May 29, 2014.

(51) Int. Cl.

| | |
|---|---|
| ***B05B 16/60*** | (2018.01) |
| ***F26B 21/00*** | (2006.01) |
| ***F26B 25/10*** | (2006.01) |

(52) U.S. Cl.

CPC ..... *B05B 16/60* (2018.02); *F26B 21/003* (2013.01); *F26B 21/004* (2013.01); *F26B 25/10* (2013.01); *F26B 2210/12* (2013.01)

(58) Field of Classification Search

CPC .. B05B 15/1222; F26B 21/003; F26B 21/004; F26B 25/10

USPC ..... 454/52

See application file for complete search history.

(56) References Cited

U.S. PATENT DOCUMENTS

| | | | | |
|---|---|---|---|---|
| 3,279,094 A * | 10/1966 | Blanton, Jr. | ..... | F26B 21/00 34/233 |
| 4,131,059 A * | 12/1978 | Gustavsson | ..... | F24F 9/00 454/189 |
| 4,270,702 A * | 6/1981 | Nicholson | ..... | B05C 11/06 118/63 |
| 4,515,313 A * | 5/1985 | Cavanagh | ..... | B05B 1/044 239/455 |

(Continued)

FOREIGN PATENT DOCUMENTS

| | | |
|---|---|---|
| RU | 23956 U1 | 7/2002 |
| SU | 1394004 A1 | 5/1988 |

OTHER PUBLICATIONS

International Search Report and Written Opinion, PCT/US2015/033282, filed May 29, 2015.

*Primary Examiner* — Steven B McAllister
*Assistant Examiner* — Allen R Schult
(74) *Attorney, Agent, or Firm* — Scherrer Patent & Trademark Law, P.C.; Stephen T. Scherrer; Monique A. Morneault

(57) ABSTRACT

The present invention relates to accelerated directional airflows for use in, preferably, paint booths. Specifically, the present invention relates to apparatuses, systems, and methods of using the same that create an accelerated directional airflow while eliminating the requirement of having multiple vents, nozzles, hoses, and the like. Even more specifically, the present invention controls airflow more efficiently, requires fewer parts, and costs less to use and maintain. Specifically, the accelerated directional airflows are useful in paint booths for drying painted parts and for ventilation.

7 Claims, 3 Drawing Sheets

(56) References Cited

U.S. PATENT DOCUMENTS

| | | | | |
|---|---|---|---|---|
| 5,127,574 | A * | 7/1992 | Mosser | B05B 15/1222 118/309 |
| 5,360,373 | A * | 11/1994 | Makulla | F24F 13/068 454/284 |
| 5,512,017 | A * | 4/1996 | Gore | B05B 15/1222 454/52 |
| 6,190,456 | B1 * | 2/2001 | Matsuda | B05B 5/08 118/308 |
| 6,192,604 | B1 * | 2/2001 | Morrison | B05B 15/1207 34/202 |
| 2002/0119254 | A1 * | 8/2002 | DeRegge | B05B 16/60 427/378 |
| 2005/0048897 | A1 | 3/2005 | Tong | |
| 2005/0087183 | A1 * | 4/2005 | Klobucar | F26B 23/02 126/21 A |
| 2013/0074362 | A1 * | 3/2013 | Lesicka | F26B 21/12 34/569 |
| 2014/0223759 | A1 * | 8/2014 | Gougoulas | F26B 5/00 34/90 |

* cited by examiner

DIRECTIONAL AIR APPARATUSES, SYSTEM, AND METHODS OF USING THE SAME

The present invention claims priority to U.S. Provisional Pat. App. No. 62/004,505 titled, "Directional Air Apparatuses, Systems, and Methods of Using the Same," filed May 29, 2014, which is incorporated herein by reference in its entirety.

TECHNICAL FIELD

The present invention relates to accelerated directional airflows for use in, preferably, paint booths. Specifically, the present invention relates to apparatuses, systems, and methods of using the same that create an accelerated directional airflow while eliminating the requirement of having multiple vents, nozzles, hoses, and the like. Even more specifically, the present invention controls airflow more efficiently, requires fewer parts, and costs less to use and maintain. Specifically, the accelerated directional airflows are useful in paint booths for drying painted parts and for ventilation.

BACKGROUND

It is, of course, generally known to use air regulation apparatuses and systems. Air regulation has generally been used for multiple purposes including, but not limited to, heating, ventilating, air-conditioning (also known as HVAC), filtration, humidifying, de-humidifying, suffocation, drying, curing, directing, and circulating. Commonly, HVAC systems are used to handle everyday needs. Other systems are more situational and implemented on an ad-hoc basis.

Painting is a common situation requiring a specific air regulation system for both drying the paint and ventilation of fumes and chemicals, such as solvents or the like. While paint may dry over time without air regulation, an air regulation system can decrease the time it takes to dry. There are multiple systems that can aide in the drying of paint including circulating air around the painted object, blowing air directly on the painted object, heating the air around the painted object, or any combination thereof. It has been found through comparative tests, that for most paint materials air velocity over the surface being dried has a greater benefit in accelerating drying than does extra heat. This is especially true with the newer waterborne finishes. Downdraft airflow is a generally accepted method for ventilation and drying paint. In downdraft, air flows vertically from a ceiling intake plenum at the top of an area, over an object, and into a filtered exhaust pit in the floor. Downdraft airflow provides a safe, clean environment while controlling overspray and contamination.

Another configuration is a crossdraft system that uses an exhaust fan to pull air in at one end of an area. Air may pass through a filtered door, enter a working area unfiltered, or be pushed in through a pressurized input plenum. Air flows parallel to the floor, across an object and into a filter bank at one end of the area. A semi-downdraft system is a "hybrid", combining features of both crossdraft and downdraft systems. Air is introduced into an area through the ceiling in the first 25-30% of the area. Then it's pulled across a working area, over an object, and into a filtered exhaust chamber at one end of the area. A side downdraft system is an economical solution for shops that can't afford or aren't able to install floor exhaust chambers. Air enters an area through a full-length ceiling plenum, and flows downward over an object. When air reaches the floor, it is pulled into floor-level filtered exhaust plenums on each side of the area.

Often, paint jobs are not entirely smooth and leave small imperfections, sometimes invisible to the naked eye. While these imperfections may not be noticeable, air and water vapor still may be retained within the small imperfections. Additionally, laminar airflows do not effectively move air and water vapor away from the entire surface of an object and a layer of air and water vapor may form around the boundary of the object. This boundary air remains stationary even when airflow is directed past the boundary air, such as with a downdraft airflow, crossdraft airflow, hybrid downdraft airflow, or any combination thereof. Not only does this boundary air impede the effects of an airflow, but the water vapor hinders the speed of evaporation and drying.

In paint shops, such as automobile repaint shops, production is limited by the time required for the paint to dry. Spray booths or other areas are frequently used both to confine paint overspray and evaporated solvents, and to reduce drying time. As used herein, the term "paint spray booth" is intended to cover both spray booths in which objects are painted and dried and booths in which a painted object is dried or cured.

In the past, paint spray booths and other areas often used an array of infrared lamps for applying heat to painted automobile or other painted object for accelerating drying. The object may be heated, for example, to about 130° F. or 55° C. during drying. In a downdraft paint spray booth or other area, the object is positioned over an open floor grate. Air and any entrained paint overspray and solvents are drawn downwardly over and around the object during spraying and drying and exhausted through the floor grate. An object within a downdraft spray booth, such as a standard sized vehicle, is typically subjected to an air flow on the order of 80 to 100 feet per minute (24.4 to 30.5 meters per minute). In a cross draft system wherein the air flows in a horizontal direction through an area, typical surface air flow velocities are about 75 to 100 feet per minute (22.9 to 30.5 meters per minute). When the object surfaces are heated to about 130° F. or 55° C. at these flow velocities, it may take up to 60 minutes for the entire object to dry sufficiently to permit removal from the area. Until the object is dry, it must be kept in the area to prevent damage to the soft paint. It should be appreciated that the total drying time is limited by the slowest drying surface areas which may not be subjected to significant air flow.

In order to increase the number of objects that can be painted in a given time, attempts have been made to decrease the drying time that each object must spend in a spray booth or other area. Most commonly, infrared heat from permanently installed or portable heat lamps is used. Since the heaters require careful positioning to be effective, permanently installed lamps may not be as effective as portable lamps. Heaters must have electrical interlocks if used inside an area or they must be rolled out of the area during spraying to reduce the risk if igniting any flammable solvents. Attempts also have been made to increase the surface air flow over objects. Nozzles have been mounted on rigidly plumbed headers along a spray booth's or other area's ceiling. Compressed air may be delivered from an external source to the nozzles for increasing the air flow over painted surfaces. However, problems have been encountered with these systems. The fixed nozzles do not offer flexibility with different vehicles. Further, there is an increased risk of contaminating the wet paint with dust, oil, or other contaminants that may be present in the compressed air. Typically, the compressed air was obtained from a conventional shop compressor and compressed air distribution systems. However, the air nozzles required a very high air flow rate in order to be effective, thereby increasing the operating costs and consuming compressed air needed for operating spray guns and other shop tools.

Having air and water vapor retained within the small imperfections around the boundary of a painted object severely restricts the drying process. Commonly, introducing a turbulent airflow eliminates this boundary air and water vapor. Accelerated directional air sources may be introduced at angles different from the downdraft airflow, such that the accelerated directional air intersects with the downdraft airflow. To create accelerated directional airflows, nozzles, jets, or other valves are generally used as focusing tools.

Previous attempts to provide accelerated drying have included fitting the sides of a spray booth with a number of directable high volume air nozzles. The nozzles are individually aimed to provide a desired high air flow rate over the sides and top of the automobile. Further, the nozzles may be aimed specifically at locations which are slow to dry from heat alone. A high volume blower, such as a squirrel cage blower, draws air from near the top of the booth and delivers the air through a manifold to the nozzles. Preferably, a blower and a number of nozzles are formed into a module or air handling device which can be retrofitted into an existing spray booth, as well as installed in new spray booths. A number of the modules are spaced around the booth for selectively directing air flow at all surface areas of a large object. The high volume air flow through the nozzles significantly accelerates the drying time for a painted automobile or other object. The blowers and the nozzles in the different modules may be independently controlled, allowing the operator to direct air at only an area which was painted for zone drying or to increase the air flow only at areas which dry slower than other areas. In these designs, each individual nozzle is formed to swivel over a wide directional range, such as at least a 60° global rotation to facilitate directing the air flow at the surface regions requiring additional drying. Consequently, a large number of nozzles may be easily and quickly set for successively drying different automobile models Nozzles increase the pressure of air by limiting the volume through the narrow end. This is a direct result of the ideal gas law equation $pV=nRT$. Air is forced through the narrow end of a nozzle at a much higher speed than that of the air when it entered the nozzle, because forcing a decrease in volume increases the pressure. When air is sprayed through the narrow end of a nozzle, it is generally expelled in a conical fashion. Depending on the type of nozzle, air may be sprayed in a solid stream, in a flat V-shaped fan, a solid cone, a hollow cone, or multiple plume spray. These nozzle sprays intersect larger radiuses the farther the spray is from the nozzle, but smaller radiuses the closer the spray is from the nozzle. Some systems provide multiple sets of nozzles to overlap sprays and accelerate wider volumes of air. However, the spaces surrounding the nozzles are often unaffected by the spray of the nozzles. This may leave gaps in the coverage of the spray from one or multiple nozzles. Therefore, a need exists for apparatuses, systems, and methods that eliminate gaps in fluid spray.

Often, upgrading or retrofitting air regulation apparatuses, systems, and methods involves cutting holes into walls, adding additional duct work, replacing or installing motors, and the like. A need, therefore, exists for standalone apparatuses, systems, and methods that can be installed without modification of the assembly the apparatus, system, and method is installed within.

Furthermore, a need exists for apparatuses, systems, and methods that accelerate air efficiently.

Moreover, a need exists for apparatuses, systems, and methods that dry painted objects more quickly and efficiently.

Additionally, a need exists for apparatuses, systems, and methods that create turbulent air when combined with downdraft airflow.

Also, a need exists for apparatuses, systems, and methods that eliminate boundary air around a painted object.

Further, a need exists for apparatuses, systems, and methods that accelerate low, room, and high temperature air.

SUMMARY OF THE INVENTION

The present invention relates to accelerated directional airflows for use in, preferably, paint booths. Specifically, the present invention relates to apparatuses, systems, and methods of using the same that create an accelerated directional airflow while eliminating the requirement of having multiple vents, nozzles, hoses, and the like. Even more specifically, the present invention controls airflow more efficiently, requires fewer parts, and costs less to use and maintain. Specifically, the accelerated directional airflows are useful in paint booths for drying painted parts and for ventilation.

To this end, in an embodiment of the present invention, an airflow apparatus is provided. The airflow apparatus comprises an intake housing comprising an air intake; a motor within the intake housing for directing airflow through the intake; a hollow extension having a first surface, a length and a volume therein protruding from the intake housing; and a first slit in the first surface, wherein the motor directs the airflow through the intake, into the hollow extension and out the first slit.

In an embodiment, the airflow apparatus further comprises a directional airflow element disposed over the first slit, wherein the directional airflow element comprises a first flange extending from the surface on a first side of the first slit and a second flange extending from the surface on a second side of the first slit.

In an embodiment, the airflow apparatus further comprises a second slit in the first surface, wherein the motor directs the airflow through the intake, into the hollow extension, and out the second slit.

In an embodiment, the first and second slits are adjacently disposed on the first surface.

In an embodiment, the second slit comprises a directional airflow element disposed over the second slit, wherein the directional airflow element comprises a first flange extending form the surface on a first side of the second slit and a second flange extending from the surface on a second side of the first slit.

In an embodiment, the airflow apparatus further comprises a first air diffuser disposed within the hollow extension, wherein the first air diffuser comprises at least one hole for the airflow to pass therethrough, said first air diffuser disposed between the intake housing and the first slit.

In an embodiment, the airflow apparatus further comprises a first air diffuser disposed within the hollow extension, wherein the first air diffuser comprises at least one hole for the airflow to pass therethrough, said first air diffuser disposed between the intake housing and the first slit; and a second air diffuser disposed within the hollow extension, wherein the second air diffuser comprises at least one hole for the airflow to pass therethrough, said second air diffuser disposed between the first slit and the second slit.

In an embodiment, the airflow apparatus further comprises an end cap on a terminal end of the hollow extension.

In an embodiment, the airflow apparatus further comprises a filter associated with the air intake for filtering air forming the airflow.

In an alternate embodiment of the present invention, a paint spray booth is provided. The paint spray booth comprises an enclosed space surrounded by walls, a ceiling, and a floor, wherein mounted on one wall is an airflow apparatus, said airflow apparatus comprising an intake housing comprising an air intake, a motor within the intake housing for directing airflow through the intake, a hollow extension having a first surface, a length and a volume therein protruding from the intake housing, and a first slit in the first surface, wherein the motor directs the airflow through the intake, into the hollow extension and out the first slit.

In an embodiment, the paint spray booth further comprises a directional airflow element disposed over the first slit of the airflow apparatus, wherein the directional airflow element comprises a first flange extending from the surface on a first side of the first slit and a second flange extending from the surface on a second side of the first slit.

In an embodiment, the paint spray booth further comprises a second slit in the first surface of the airflow apparatus, wherein the motor directs the airflow through the intake, into the hollow extension, and out the second slit.

In an embodiment, the first and second slits of the airflow apparatus are adjacently disposed on the first surface.

In an embodiment, the second slit of the airflow apparatus comprises a directional airflow element disposed over the second slit, wherein the directional airflow element comprises a first flange extending form the surface on a first side of the second slit and a second flange extending from the surface on a second side of the first slit.

In an embodiment, the paint spray booth further comprises a first air diffuser disposed within the hollow extension of the airflow apparatus, wherein the first air diffuser comprises at least one hole for the airflow to pass therethrough, said first air diffuser disposed between the intake housing and the first slit.

In an embodiment, the paint spray booth further comprising: a first air diffuser disposed within the hollow extension of the airflow apparatus, wherein the first air diffuser comprises at least one hole for the airflow to pass therethrough, said first air diffuser disposed between the intake housing and the first slit; and a second air diffuser disposed within the hollow extension of the airflow apparatus, wherein the second air diffuser comprises at least one hole for the airflow to pass therethrough, said second air diffuser disposed between the first slit and the second slit.

In an embodiment, the first surface is angled downwardly toward the floor to direct the airflow toward the floor.

In an embodiment, the paint spray booth further comprises a filter associated with the air intake for filtering air forming the airflow.

In an embodiment, the paint spray booth further comprises a ventilation system for removing air from the enclosed space.

In an embodiment, the paint spray booth further comprises an object disposed within the enclosed area, the airflow apparatus directing the airflow around the object for curing paint disposed on the object.

It is, therefore, an advantage and objective of the present invention to provide for apparatuses, systems, and methods that that accelerate air efficiently It is an advantage and objective of the present invention to provide for standalone apparatuses, systems, and methods that can be installed without modification of the assembly the apparatus, system, and method is installed within.

Furthermore, it is an advantage and objective of the present invention to provide for apparatuses, systems, and methods that eliminate gaps in fluid spray.

Additionally, it is an advantage and objective of the present invention to provide for apparatuses, systems, and methods that create turbulent air when combined with downdraft airflow.

Also, it is an advantage and objective of the present invention to provide for apparatuses, systems, and methods that eliminate boundary air around a painted object.

Further, it is an advantage and objective of the present invention to provide for apparatuses, systems, and methods that accelerate low, room, and high temperature air.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to accelerated directional airflows for use in, preferably, paint booths. Specifically, the present invention relates to apparatuses, systems, and methods of using the same that create an accelerated directional airflow while eliminating the requirement of having multiple vents, nozzles, hoses, and the like. Even more specifically, the present invention controls airflow more efficiently, requires fewer parts, and costs less to use and maintain. Specifically, the accelerated directional airflows are useful in paint booths for drying painted parts and for ventilation.

Figure 1:
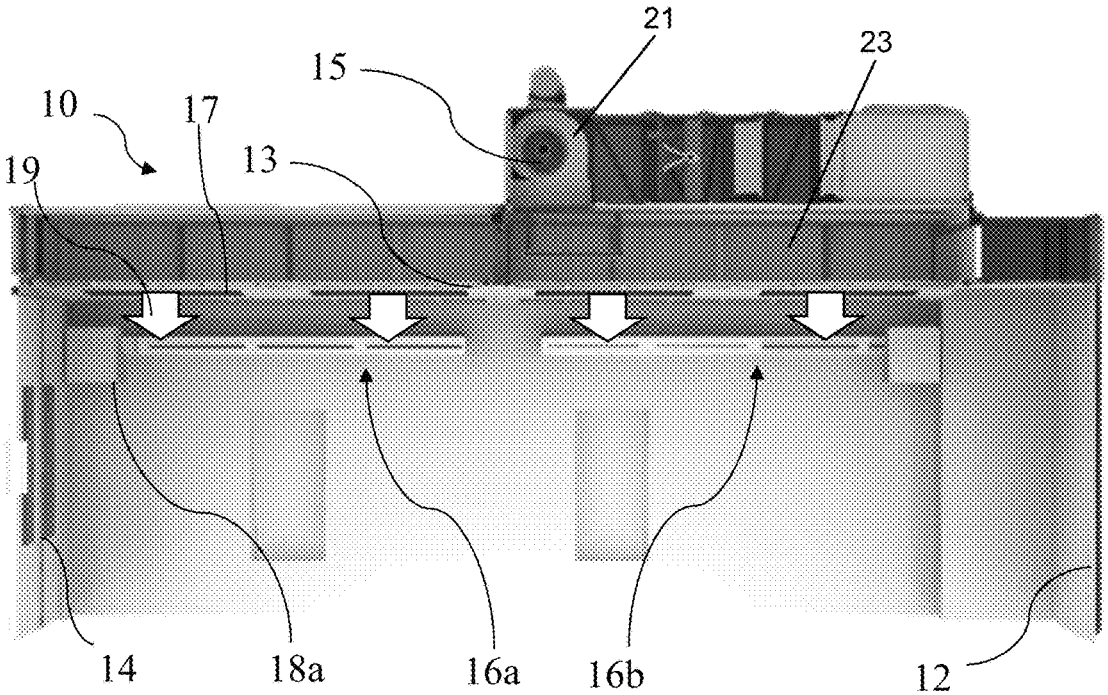
FIG. 1 illustrates a partial view of an area with an accelerator installed in an embodiment of the present invention.

The terms fluid and flow as described herein are used to refer to a substance whose molecules flow freely, so that it has no fixed shape and little resistance to outside stress, which may be a liquid or a gas. It is not intended to limit disclosure to either a liquid or gas as these substances are both capable of being described with fluid dynamics. Further, while the present invention may have air regulation as one of the embodiments, use of liquids such as water may be used similarly without departing from the spirit and scope of the present invention and without diminishing its attendant advantages Now referring to the figures, wherein like numerals refer to like parts, FIG. 1 illustrates an area 10, which may be a paint booth in one embodiment of the present invention. The area 10 may comprise a plurality of walls 12, a ceiling 13, and at least one door 14. Within the area 10 may be at least one fluid accelerator 16*a* or 16*b*. There may be sufficient space between the at least one fluid accelerator 16*a* or 16*b* and the ceiling 13 so that fluid may be able to flow around, beneath, and above the at least one fluid accelerator 16*a* or 16*b*. The area 10 may further comprise a ventilation system 15 disposed above the ceiling 13, wherein fluid may be expelled therefrom, sucked into, or recirculated therethrough. The ventilation system 15 may work independently of the at least one accelerator 16*a* or 16*b*, may be used concurrently, or may be dependent on the at least one accelerator 16*a* or 16*b*. Of course, the at least one accelerator 16*a* or 16*b* may also be dependent on the ventilation system 15 in one embodiment of the present invention. In a preferred embodiment of the present invention, fluid may flow from the ventilation system 15 and enter into the at least one accelerator 16*a* or 16*b*.

Figure 2:
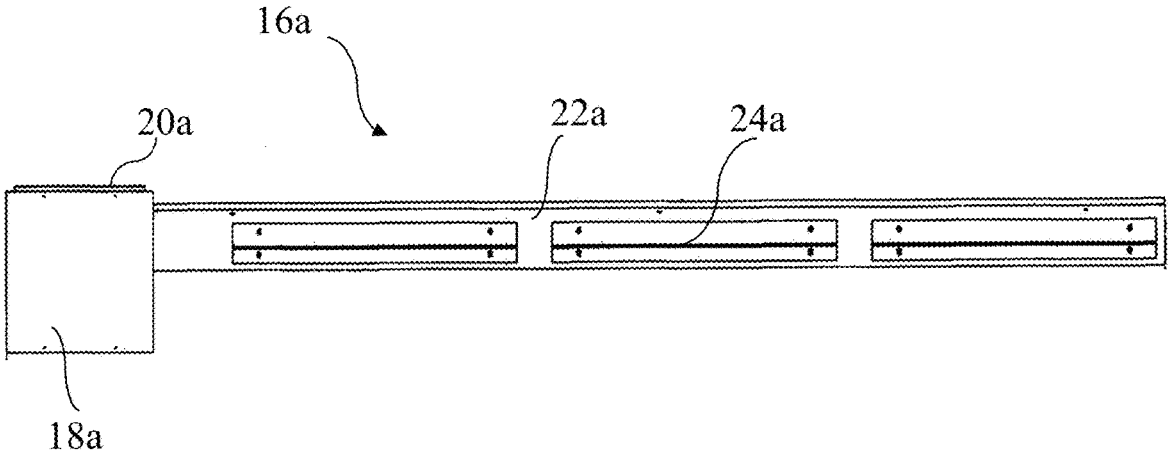
FIG. 2 illustrates a side view of a right oriented accelerator in an embodiment of the present invention.

The at least one fluid accelerator 16*a* or 16*b* may be a right oriented accelerator 16*a* or a left oriented accelerator 16*b*. On a first end of the right oriented accelerator 16*a* may an intake housing 18*a*. The intake housing 18*a* may comprise an intake 20*a* disposed on a side of the intake housing 18*a* as shown in FIG. 2. Inside the intake housing 18*a* may be a motor (not shown) that may suck fluid through the intake 20*a*, through a filter (not shown), and expel it into an extension 22*a*. The extension 22*a* may protrude outwardly from the intake housing 18*a* and may be connected and sealed such that fluid may flow between the intake housing 18*a* and the extension 22*a* but may not flow out the connection between the intake housing 18*a* and the extension 22*a*. The extension 22*a* may have at least one opening 24*a* having a surface area smaller than the surface area of the extension 22*a*, wherein fluid may flow from the extension 22*a* through the at least one opening 24*a*.

The at least one opening 24*a* may be sufficiently small such that the fluid flow out the at least one opening 24*a* decreases its volume and increases its pressure. The increase in pressure can be translated into an increase in velocity. The increase in velocity over time can be translated into acceleration, such that the flow may be accelerated out from the extension 22*a* and through the at least one opening 24*a*.

In one embodiment, the at least one opening 24*a* may be a horizontal slot as shown in FIG. 2. In this embodiment, the height of the at least one opening 24*a* may be sufficiently small while the width of the at least one opening 24*a* may be elongated. The sufficiently small height of the at least one opening 24*a* may still allow fluid flow to be accelerated outwardly from the right oriented accelerator 16*a*. The elongated width of the at least one opening 24*a* may provide for a broad level spray of fluid to be accelerated outwardly from the right oriented accelerator 16*a*.

Figure 3:
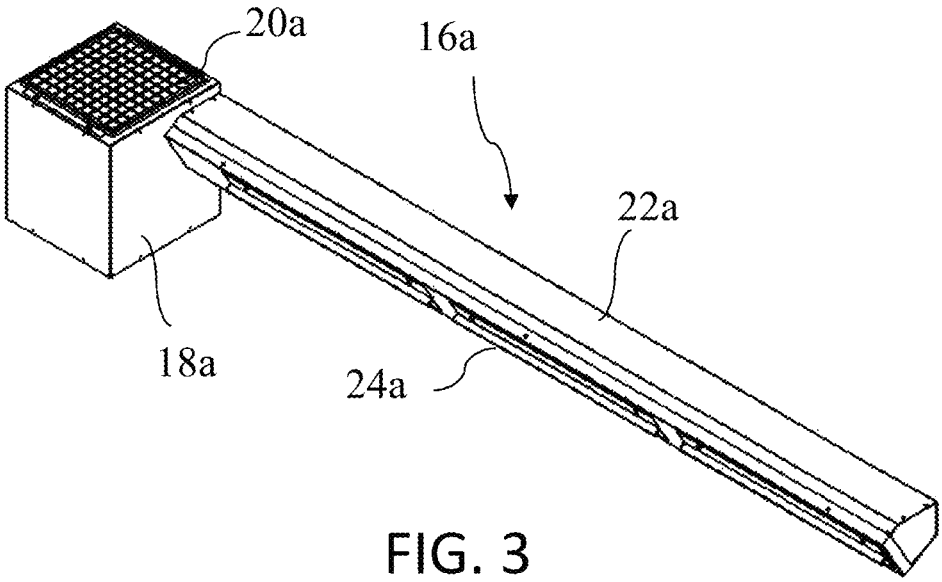
FIG. 3 illustrates a perspective view of the right oriented accelerator in an embodiment of the present invention.

As shown in FIG. 3, the extension 22*a* may be designed to angle the at least one opening 24*a* at an angle. This angle may be pre-determined and the right oriented accelerator 16*a* may be manufactured in accordance with the predetermined angle. Alternatively, the angle may be determined during installation. In another embodiment of the present invention, the extension 22*a* may be rotatable about the connection between the intake housing 18*a* and the extension 22*a*, such that a user may be able to determine the angle of fluid acceleration at a time of use.

Figure 4:
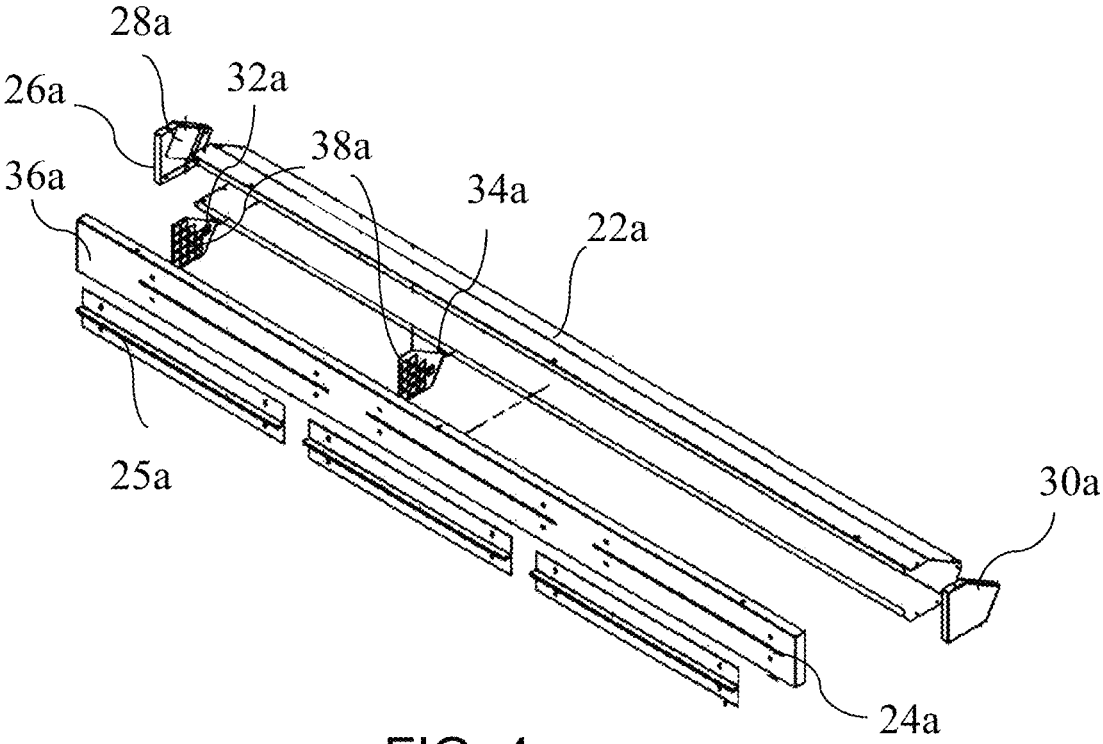
FIG. 4 illustrates a perspective exploded view of an extension of the right oriented accelerator in an embodiment of the present invention.

As shown in FIGS. 3-4, the at least one opening 24*a* may have a plurality of flanges 25*a* extending away from the extension 22*a*. The plurality of flanges 25*a* may focus the fluid flow from the at least one opening 24*a* and may prevent an unwanted spread of the fluid flow in the vertical direction. Further shown in FIG. 4 is an exploded view of the extension 22*a*. The extension 22*a* may be manufactured metal, plastic, or other like material and may be bent in multiple locations. The extension 22*a* initially may be open on three sides and subsequently enclosed by attaching a connector 26*a*, an opening wall 36*a*, and a cap 30*a*. Specifically, the connector 26*a* may have an entry 28*a* wherein fluid may flow therethrough. The connector 26*a* may be attached to the intake housing 18*a* (shown in FIG. 3) on a first side of the connector 26*a* and attached to a first side of the extension 22*a* on a second side of the connector 26*a*.

The extension 22*a* may generally be hollow and may end with the cap 30*a* on a second side of the extension 22*a*. The cap 30*a* may enclose the extension 22*a* and may prevent fluid flow from exiting the second side of the extension 22*a*. There may be a first diffuser 32*a* and a second diffuser 34*a* disposed throughout the extension 22*a*. Of course, any number of diffusers may be present. The first and second diffusers 32*a*, 34*a* may control fluid flow speed and direction, evenly distribute the flow of fluid, minimize noise, and any combination thereof. In one embodiment, the first diffuser 32*a* may be disposed on a first side of the at least one opening 24*a* and the second diffuser 34*a* may be disposed on a second side of the at least one opening 24*a*, as seen in FIG. 4.

The first and second diffusers 32*a*, 34*a* may have a plurality of apertures 38*a* to accommodate particular functions. For example, the first diffuser 32*a* may have 18 apertures while the second diffuser 34*a* has 12 apertures. The second diffuser 34*a* may have less apertures 38*a* than the first diffuser 32*a* so that the pressure within the extension 22*a* remains constant, while taking into account any fluid flow out of the at least one opening 24*a*. The at least one opening 24*a* may be disposed on the opening wall 36*a*, which may be attached to the front of the extension 22*a*. With the connector 26*a*, the opening wall 36*a*, and the cap 30*a* attached to the extension 22*a*, the extension 22*a* may be enclosed, except for the entry 28*a*, the plurality of apertures 38*a*, and the at least one opening 24*a* mentioned above. The plurality of flanges 25*a* may be attached directly on the opening wall 36*a* and around the at least one opening 24*a*.

Figure 5:
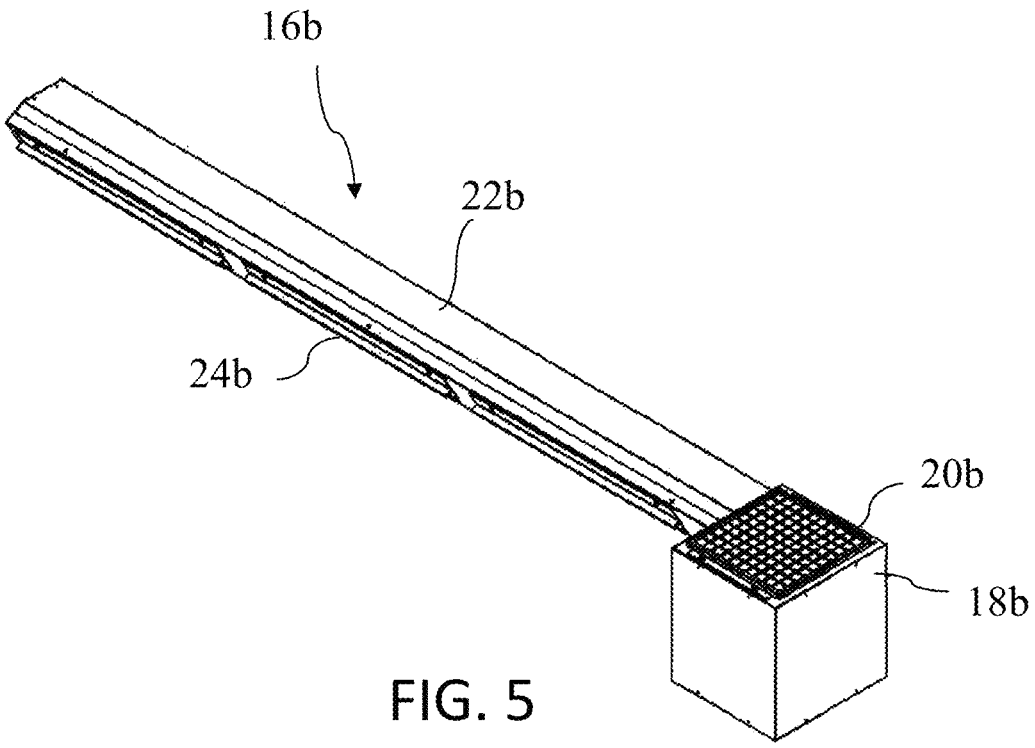
FIG. 5 illustrates a perspective view of a left oriented accelerator in an embodiment of the present invention.
Figure 6:
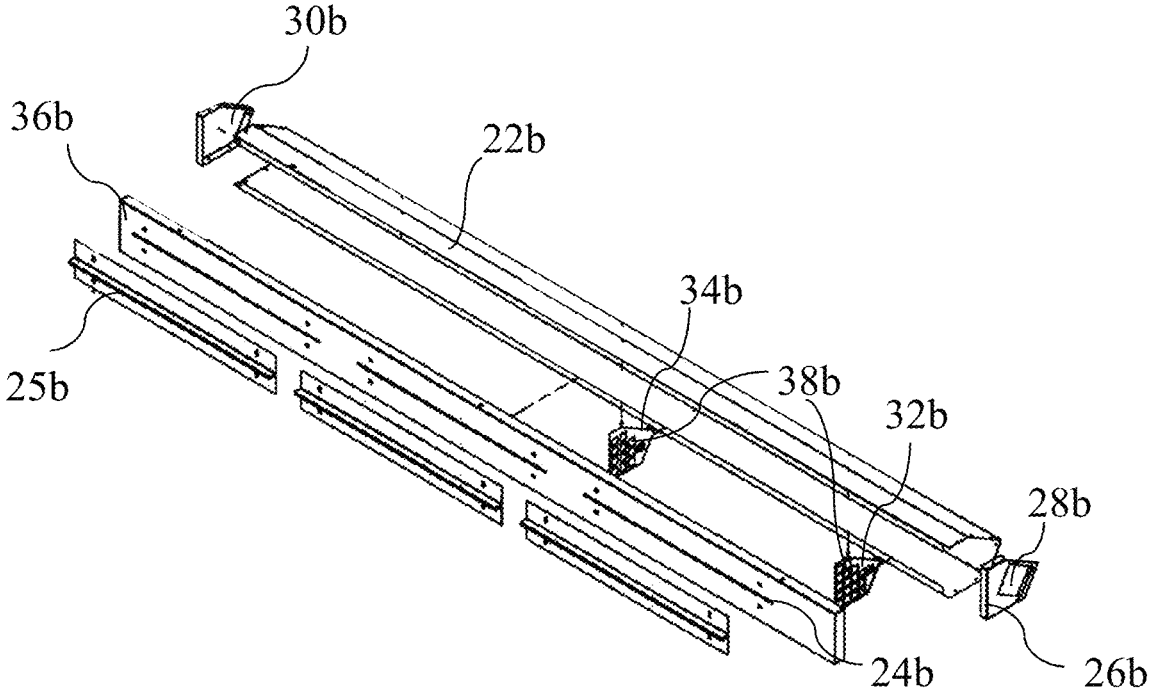
FIG. 6 illustrates a perspective exploded view of an extension of the left oriented accelerator in an embodiment of the present invention.

FIG. 5 illustrates a left oriented accelerator 16*b*, which functions similarly to the right oriented accelerator 16*a* discussed above. On a first end of the left oriented accelerator 16*b* may an intake housing 18*b*. The intake housing 18*b* may comprise an intake 20*b* disposed on a side of the intake housing 18*b* as shown in FIG. 2. Inside the intake housing 18*b* may be a motor (not shown) that may suck fluid through the intake 20*b*, through a filter (not shown), and expel it into an extension 22*b*. The extension 22*b* may protrude outwardly from the intake housing 18*b* and may be connected and sealed such that fluid may flow between the intake housing 18*b* and the extension 22*b* but may not flow out the connection between the intake housing 18*b* and the extension 22*b*. The extension 22*b* may have at least one opening 24*b* having a surface area smaller than the surface area of the extension 22*b*, wherein fluid may flow from the extension 22*b* through the at least one opening 24*b*. The at least one opening 24*b* may be sufficiently small such that the fluid flow out the at least one opening 24*b* decreases its volume and increases its pressure. The increase in pressure can be translated into an increase in velocity. The increase in velocity over time can be translated into acceleration, such that the flow may be accelerated out from the extension 22*b* and through the at least one opening 24*b*. In one embodiment, the at least one opening 24*b* may be a horizontal slot as shown in FIG. 6. In this embodiment, the height of the at least one opening 24*b* may be sufficiently small while the width of the at least one opening 24*b* may be elongated. The sufficiently small height of the at least one opening 24*b* may still allow fluid flow to be accelerated outwardly from the left oriented accelerator 16*b*. The elongated width of the at least one opening 24*b* may provide for a broad level spray of fluid to be accelerated outwardly from the left oriented accelerator 16*b*.

As further shown in FIG. 5, the extension 22*b* may be designed to direct the at least one opening 24*b* at an angle. This angle may be pre-determined and the left oriented accelerator 16*b* may be manufactured in accordance with the pre-determined angle. Alternatively, the angle may be determined during installation. In another embodiment of the present invention, the extension 22*b* may be rotatable about the connection between the intake housing 18*b* and the extension 22*b*, such that a user may be able to determine the angle of fluid acceleration at a time of use.

As shown in FIGS. 5-6, the at least one opening 24*b* may have a plurality of flanges 25*b* extending away from the extension 22*b*. The plurality of flanges 25*b* may focus the fluid flow from the at least one opening 24*b* and may prevent an unwanted spread of the fluid flow in the vertical direction. Further shown in FIG. 6 is an exploded view of the extension 22*b*. The extension 22*b* may be manufactured metal, plastic, or other like material and may be bent in multiple locations. The extension 22*b* may initially be open on three sides and subsequently enclosed by attaching a connector 26*b*, an opening wall 36*b*, and a cap 30*b* thereon. Specifically, the connector 26*b* may have an entry 28*b* wherein fluid may flow therethrough. The connector 26*b* may be attached to the intake housing 18*b* on a first side of the connector 26*b* and attached to a first side of the extension 22*b* on a second side of the connector 26*b*. The extension 22*b* may generally be hollow and may end with the cap 30*b* on a second side of the extension 22*b*. The cap 30*b* may enclose the extension 22*b* and may prevent fluid flow from exiting the second side of the extension 22*b*.

There may be a first diffuser 32*b* and a second diffuser 34*b* disposed throughout the extension 22*b*. Of course, any number of diffusers may or may not be present. The first and second diffusers 32*b*, 34*b* may control fluid flow speed, direction, and distribution; minimize noise; and any combination thereof. In one embodiment, the first diffuser 32*b* may be disposed on a first side of the at least one opening 24*b* and the second diffuser 34*b* may be disposed on a second side of the at least one opening 24*b*, as seen in FIG. 6.

The first and second diffusers 32*b*, 34*b* may have a plurality of apertures 38*b* to accommodate particular functions. For example, the first diffuser 32*b* may have 18 apertures while the second diffuser 34*b* has 12 apertures. The second diffuser 34*b* may have less apertures 38*b* than the first diffuser 32*b* so that the pressure within the extension 22*b* remains constant, while taking into account any fluid flow out of the at least one opening 24*b*. The at least one opening 24*b* may be disposed on the opening wall 36*b*, which may be attached to the front of the extension 22*b*. With the connector 26*b*, the opening wall 36*b*, and the cap 30*b* attached to the extension 22*b*, the extension 22*b* may be enclosed, except for the entry 28*b*, the plurality of apertures 38*b*, and the at least one opening 24*b* mentioned above. The plurality of flanges 25*b* may be attached directly on the opening wall 36*b* and around the at least one opening 24*b*.

It should be apparent to one skilled in the art that the present invention described above may take in fluid, such as air, water, water vapor, or the like through the intake by engaging the motor within the intake. The fluid may be sucked in from around the present invention and sent into the extension via the gate between the extension and the intake housing. The fluid may fill the extension up to the cap and may further be forced through the at least one openings 24*a*, 24*b* at an accelerated rate and in a flat level spray. As illustrated in FIG. 1, the flat level spray of fluid accelerated from the present invention may be used concurrently with a ventilation system 15 comprising an air mover 21 in airflow communication with an upper space 23 above the ceiling 13 that provides a downdraft fluid flow 19 through vents 17 in the ceiling 13, such that the interference of the multiple fluid flow creates turbulent air that can eliminate any air, water vapor, or other contaminants contained in paint imperfections. The flat level spray of fluid covers a broader range than that of conical spray nozzles and may evenly distribute turbulent air along the flat level broad range.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A paint spray booth comprising:

an enclosed space surrounded by walls, a ceiling, and a floor, wherein mounted on a first wall is a first airflow apparatus, said first airflow apparatus comprising a first intake housing comprising a first air intake, a first air mover within the first intake housing configured to direct a first airflow through the first intake, a first hollow extension protruding from the first intake housing, the first hollow extension having a first surface, a length and a width perpendicular to the length wherein the length is greater than the width, and a volume therein, wherein the first hollow extension is mounted to the first wall such that the length of the first hollow extension is disposed horizontally on the first wall adjacent to the ceiling, wherein the first surface is flat and comprises an elongated first slit in the first surface of the first hollow extension running a direction of the length of the first hollow extension and wherein a first directional airflow element is disposed on the first surface of the first hollow extension, wherein the first air mover directs the first airflow through the first intake, into the first hollow extension, out the first slit of the first hollow extension and through the first directional airflow element of the first hollow extension forming first accelerated air and directing the first accelerated air into the enclosed space; and a second airflow apparatus comprising a second intake housing comprising a second air intake, a second air mover within the second intake housing configured to direct second airflow through the second intake, a second hollow extension protruding from the second intake housing, the second hollow extension having a first surface, a length and a width perpendicular to the length wherein the length is greater than the width, and a volume therein, wherein the second hollow extension is mounted such that the length of the second hollow extension is disposed horizontally adjacent to the ceiling, wherein the first surface of the second hollow extension is flat and comprises an elongated first slit in the first surface of the second hollow extension running a direction of the length of the second hollow extension and a first directional airflow element is disposed on the first surface of the second hollow extension, wherein the second air mover directs the second airflow through the second intake, into the second hollow extension, out the first slit of the second hollow extension and through the first directional airflow element of the second hollow extension forming second accelerated air and directing the second accelerated air into the enclosed space;

a ventilation system comprising a third air mover in airflow communication with an upper space above the ceiling of the enclosed space, the ceiling having a plurality of vents each of the plurality of vents providing airflow communication between the upper space and the enclosed space, wherein a first vent of the plurality of vents is positioned in the ceiling, the first vent of the plurality of vents forming a first downdraft airflow generated from the third air mover directing air into the upper space and through the first vent of the plurality of vents, the first vent positioned so that the first downdraft airflow from the first vent of the plurality of vents is directed into the path of the first accelerated air forced from the first airflow apparatus, and wherein a second vent of the plurality of vents is positioned in the ceiling, the second vent of the plurality of vents forming a second downdraft airflow generated from the third air mover directing the air into the upper surface and through the second vent of the plurality of vents, the second vent positioned so that the second downdraft airflow from the second vent of the plurality of vents is directed into the path of the second accelerated air forced from the second airflow apparatus;

an object within the enclosed space configured to be painted, wherein the first accelerated air forced from the first airflow apparatus is configured to combine with and interfere with the first downdraft airflow from the first vent of the plurality of vents in the ceiling to form a first turbulent airflow within the enclosed space above the object and directed downwardly at the object, and the second accelerated air forced from the second airflow apparatus is configured to combine with and interfere with the second downdraft airflow from the second vent of the plurality of vents in the ceiling to form a second turbulent airflow within the enclosed space above the object and directed downwardly at the object;

a second slit in the first surface of the first airflow apparatus, wherein the first air mover directs the first airflow through the first intake, into the first hollow extension, and out the second slit;

a first air diffuser disposed within the first hollow extension of the first airflow apparatus, wherein the first air diffuser comprises at least one hole for the first airflow to pass therethrough, said first air diffuser disposed between the first intake housing and the first slit of the first airflow apparatus; and a second air diffuser within the first hollow extension of the first airflow apparatus, wherein the second air diffuser comprises at least one hole for the first airflow to pass therethrough, said second air diffuser disposed between the first slit and the second slit of the first airflow apparatus.

2. The paint spray booth of claim 1 wherein the first and second slits in the first surface of the first airflow apparatus are adjacently disposed in the first surface.

3. The paint spray booth of claim 1 wherein the second slit of the first airflow apparatus comprises a second directional airflow element disposed over the second slit, wherein the second directional airflow element of the first airflow apparatus comprises a first flange extending from the first surface on a first side of the second slit of the first airflow apparatus and a second flange extending from the first surface on a second side of the second slit of the first airflow apparatus.

4. The paint spray booth of claim 1 wherein the first surface of the first airflow apparatus is angled downwardly toward the floor to direct the first airflow toward the floor.

5. The paint spray booth of claim 1 further comprising:

a filter associated with the first air intake for filtering air forming the first airflow.

6. The paint spray booth of claim 1 wherein the object is a vehicle.

7. The paint spray booth of claim 1 wherein the first directional airflow element of the first airflow apparatus comprises a first flange extending from the first surface on a first side of the first slit of the first airflow apparatus and a second flange extending from the first surface on a second side of the first slit of the first airflow apparatus.

* * * * *